US012006817B2

(12) United States Patent
Arab et al.

(10) Patent No.: US 12,006,817 B2
(45) Date of Patent: Jun. 11, 2024

(54) CUP TESTER UNIT

(71) Applicant: Abu Dhabi National Oil Company, Abu Dhabi (AE)

(72) Inventors: Mohammed Abu Arab, Abu Dhabi (AE); Omar Auf Abdul Rahman, Abu Dhabi (AE)

(73) Assignee: Abu Dhabi National Oil Company, Abu Dhabi (AE)

( * ) Notice: Subject to any disclaimer, the term of this patent is extended or adjusted under 35 U.S.C. 154(b) by 0 days.

(21) Appl. No.: 17/775,705

(22) PCT Filed: Nov. 12, 2019

(86) PCT No.: PCT/IB2019/059698
§ 371 (c)(1),
(2) Date: May 10, 2022

(87) PCT Pub. No.: WO2021/094809
PCT Pub. Date: May 20, 2021

(65) Prior Publication Data

US 2022/0341314 A1 Oct. 27, 2022

(51) Int. Cl.
*E21B 47/117* (2012.01)
*E21B 33/04* (2006.01)
*E21B 33/06* (2006.01)

(52) U.S. Cl.
CPC ..... *E21B 47/117* (2020.05); *E21B 33/04* (2013.01); *E21B 33/06* (2013.01)

(58) Field of Classification Search
CPC ..... E21B 47/117; E21B 33/04; E21B 33/06
See application file for complete search history.

(56) References Cited

U.S. PATENT DOCUMENTS 3,177,703 A * 4/1965 Waters ..... E21B 47/117 166/387
3,712,115 A * 1/1973 Miller ..... G01M 3/2853 73/49.1
4,018,276 A * 4/1977 Bode ..... E21B 33/1294 166/183
4,090,395 A 5/1978 Dixon et al.
4,559,809 A * 12/1985 Mayo ..... E21B 47/117 73/49.1

(Continued)

FOREIGN PATENT DOCUMENTS

CN 201083101 Y * 7/2008
WO 2015152888 A1 10/2015

OTHER PUBLICATIONS

International Search Report and Written Opinion of the International Searching Authority for corresponding International Patent Application No. PCT/IB2019/059698, mailed Aug. 31, 2020.

*Primary Examiner* — Taras P Bemko
(74) *Attorney, Agent, or Firm* — Renner, Otto, Boisselle & Sklar, LLP

(57) ABSTRACT

Cup tester unit comprising a BOP test plug insertable into a casing head housing, for sealing a space of drilling systems above the BOP test plug; a hanger connected to the lower end of the BOP test plug; and a test cup assembled at the outer circumference of the hangers, for sealing with the inner surface of a well casing. Further, a method of testing a of drilling systems and a connection between a well casing and a casing head housing is claimed.

4 Claims, 1 Drawing Sheet

(56) References Cited

U.S. PATENT DOCUMENTS

| | | | | |
|---|---|---|---|---|
| 6,152,225 | A * | 11/2000 | Young | E21B 33/06 166/337 |
| 7,207,384 | B2 | 4/2007 | Dallas et al. | |
| 8,899,315 | B2 * | 12/2014 | Nguyen | E21B 33/03 166/85.1 |
| 2005/0199389 | A1 * | 9/2005 | Dallas | E21B 47/117 166/250.07 |
| 2005/0269079 | A1 | 12/2005 | Franklin | |
| 2017/0101840 | A1 * | 4/2017 | Kauffmann | E21B 23/01 |
| 2017/0241230 | A1 * | 8/2017 | Cruickshanks | E21B 34/045 |
| 2021/0277738 | A1 * | 9/2021 | Mukhlifi | E21B 33/06 |

* cited by examiner

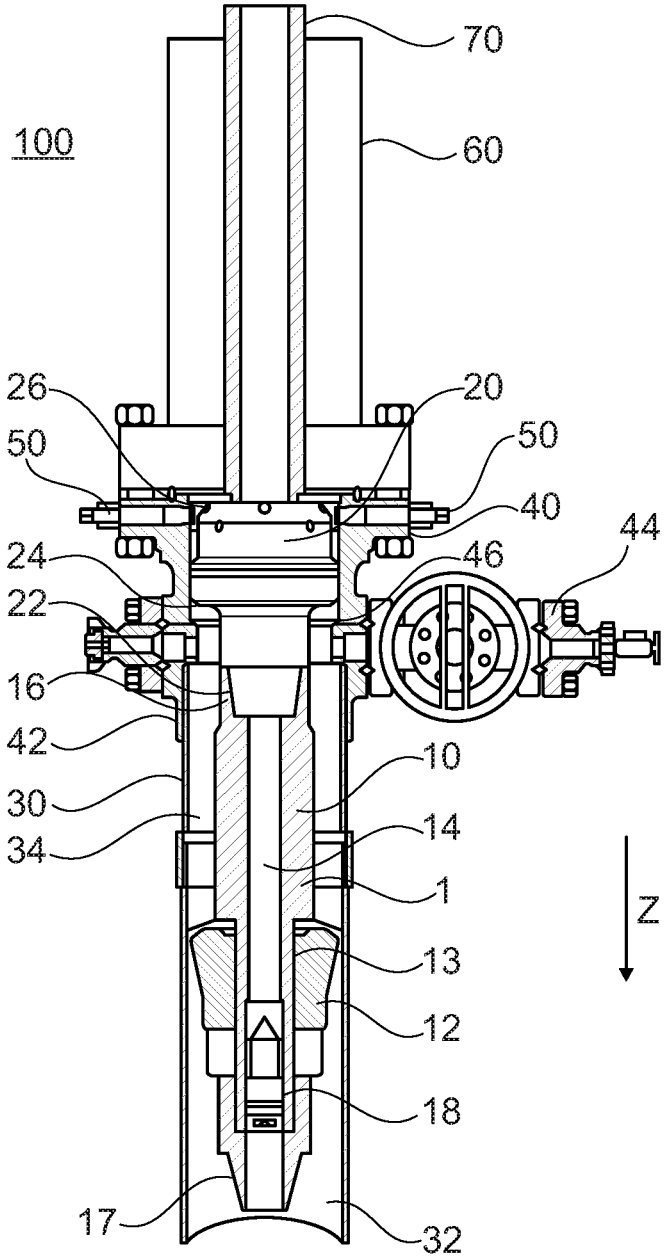
100
70
60
26
20
50
50
40
44
24
46
22
16
42
10
30
14
34
1
Z
13
12
18
17
32

CUP TESTER UNIT

This application is a national phase of International Application No. PCT/IB2019/059698 filed Nov. 12, 2019, which is hereby incorporated herein by reference in its entirety.

1. FIELD OF THE INVENTION

The invention relates to pressure testing tools for pressure testing the casing head housing bottom connection with the casing simultaneously with blow out preventer (BOP) pressure testing in oil and gas wells.

2. PRIOR ART

A blow out preventer (BOP) effectively seals the wellhead lower section, particularly the casing head housing, to regulate suddenly arising erratic pressures and uncontrolled flows emanating from the formation below which are also referred to as formation uncontrolled kicks. The BOP is then used to seal the flow channel of a well and/or to severe shear the drill string and completely shut the well down, if need arises. Such BOP has to be verified prior to operation.

During installation of a casing head housing of a wellhead part, the casing head housing is connected to the surface well casing either via threaded connection or any other connection type (such as slip on weld (SOW), slip on lock (SOL), etc.). Usually, this connection cannot be tested and verified. Thus, this connection is considered as unassured leak path which might lead problems in the future.

In general, cup testers for casings are well known in the art. The prior art document U.S. Pat. No. 7,207,384 discloses a test plug tool for use in testing pressure integrity of a pressure control stack mounted to a wellhead, including a joint between a casing and a casing support in the wellhead. The test plug tool includes a fluted test plug hanger and cup tool connected thereto. However, the cup tester hanger comprises fluid passages at the hanger flange and is not usable for testing a BOP. This is because the test pressure above the cup tester hanger is equal to the one below the hanger and should not exceed 80% of the casing burst pressure. However, such pressure is much less that the BOP and wellhead test pressure. To test the BOP the test plug tool must be removed, and a BOP test plug has to be installed, which costs about 6 hours of rig time.

Thus, with the test plug tool of the prior art it is not possible perform a BOP test operation without replacing the test plug tool.

Therefore, it is an object of the present invention to overcome the above mentioned drawbacks of the prior art.

3. SUMMARY OF THE INVENTION

The above mentioned problems are solved by a cup tester unit according to claim 1 and a method of testing a wellhead arrangement according to claim 11.

Preferably the above mentioned problems are solved by a cup tester unit comprising a BOP test plug insertable into a casing head housing, for sealing a space of drilling systems above the BOP test plug; a hanger connected to the lower end of the BOP test plug; and a test cup assembled at the outer circumference of the hanger, for sealing with the inner surface of a well casing. By such a cup tester unit it is possible to perform the BOP test operation with the same device that is used for testing the connection between the casing and the casing head housing. Such test operations can further be done simultaneously. It is not required to remove the test cup and its hanger for using the BOP test plug. This saves several hours of rig time and the associated costs. The cup tester unit can preferably used for drilling systems like BOPs, hydril or raisers.

The BOP test plug seals a space of the wellhead and can withstand the very high pressures used for a BOP test procedure.

The test cup by the hanger is arranged in the casing below the BOP test plug and seals the space within the casing and the wellhead above the test cup. The BOP test plug additionally seals this space below its position such that the pressure test of the connection between the casing and the casing head housing can be performed.

Preferably, the hanger has an elongate mandrel shape. Thereby, the hanger positions the test cup below the connection between the casing and the casing head housing.

Preferably, the hanger comprises an axial bore, which is selectively closed at the lower end thereof by a back-pressure valve or blind plug or kept open without any plug or valve. The use of a back pressure valve or a blind plug depends on the respective application, operations conditions and requirements.

Preferably, the back-pressure valve is a one-way valve, which allows a flow of fluid from the bore into the wellbore and does not allow a flow of fluid from the wellbore into the bore to control the well in case of unexpected pressure (well kick). A blind plug, however, does not allow any fluid flow.

Preferably, the hanger comprises a box thread arrangement at the upper end of the hanger for a threaded connection with the BOP test plug. Thus, the BOP test plug can be separated from the test cup for exchange or maintenance.

Preferably, the BOP test plug comprises a pin thread arrangement at the upper end of the BOP test plug for a threaded connection with the hanger.

Preferably, the hanger comprises a pin thread arrangement at the lower end of the hanger. Thus, the cup tester unit can be connected to further equipment arranged further down the well casing.

Preferably, the test cup is particularly suitable for relatively high pressure sealing to the inner wall of the casing as it increases sealing pressure when the test pressure raises. Preferably, the test cup is an elastomeric seal cup body.

Preferably, the BOP test plug comprises ring-shaped sealing surface for sealing with a corresponding ring-shaped loading shoulder of the casing head housing. Thereby, the BOP test plug can withstand very high test pressures used for testing the BOP.

Preferably, the ring-shaped sealing surface is tapered in vertical downward direction. The above mentioned problems are preferably solved by a method of drilling systems and a connection between a well casing and a casing head housing by a cup tester unit as described above, comprising the following steps:

a. Inserting of fluid pressure to the drilling system into the space above the BOP test plug for testing a BOP; and
b. Inserting of fluid pressure to the casing head housing through a casing head housing side outlet into the space between the well casing below the BOP test plug and above the test cup.

By this method, the BOP and the connection between a well casing and a casing head housing can be pressure tested without changing the test device, particularly without removing the test cup prior the test of the BOP.

Preferably, the steps a. and b. are performed at least partially at the same time. This saves time and testing effort.

4. SHORT DESCRIPTION OF THE DRAWINGS

In the following, preferred embodiments of the invention are disclosed by reference to the accompanying FIGURE, in which shows:

FIG. 1 a partial sectional side view of an embodiment of a wellhead with an embodiment of a cup tester unit according to the invention inserted.

5. DETAILED DESCRIPTION OF PREFERRED EMBODIMENTS

In the following, preferred embodiments of the invention are described in detail with respect to the FIGURE.

FIG. 1 shows partial sectional side view of an embodiment of a wellhead 100 with an embodiment of a cup tester unit 1 almost fully inserted for pressure testing the BOP (not shown) and pressure testing the connection 42 between the well casing 30 and the casing head housing 40.

The cup tester unit 1 comprises a BOP test plug 20, a hanger 10 connected to the lower end of the BOP test plug 20 and a test cup 12 arranged at the outer circumference of the hanger 10. The cup tester unit 1 is inserted into the casing head housing 40 of the wellhead 100 from the upper end thereof.

The wellhead 100 comprises from bottom to top an upper part of a well casing 30, the casing head housing 40 connected to the well casing 30, a riser 60 connected to the casing head housing 40, and a drill pipe 70 inserted into the riser 60. The casing head housing 40 has a connection 42 to the casing 30 which can be a threaded connection or of any other connection type (SOW, SOL, etc.), for example a welded connection. The casing head housing 40 further comprises one or more high pressure casing head housing side outlet valve 44 for in-between casing connection circulation or releasing of fluid pressure.

The BOP test plug 20 is further tapered in vertical downward direction Z from bottom side and comprises a ring-shaped sealing surface 24 which in fully inserted condition abuts a corresponding ring-shaped loading shoulder 46 of the casing head housing 40. The ring-shaped sealing surface 24 seals on the casing head housing 40 when test plug 20 reaches to casing head housing loading shoulder stopper 46. Thus, the weight of the cup tester unit 1 is taken by the loading shoulder 46 and the hanger 10 with the test cup 12 can hang freely into the casing 30 below the BOP test plug 20. The sealing surface 24 seals any pressure from above and below the BOP test plug 20, particularly it seals the high pressures used during a BOP pressure test operation. The BOP (not shown) is arranged at the wellhead 100 above the BOP test plug 20. For securing the BOP test plug 20 in place lockdown screws 50 are provided, that can actuate onto a ring-shaped chamfer 26 at the top of the BOP test plug 20. If the lockdown screws 50 are screwed in, the BOP test plug cannot move upwards within the wellhead boo.

The BOP test plug 20 comprises at its lower end a pin thread arrangement 22 for a threaded connection with a box thread arrangement 16 at the upper end of the hanger 10. The hanger 10 has an elongate mandrel shape and comprises an axial bore 14. The axial bore 14 is selectively closed at the lower end by a one-way backpressure valve 18 or a blind plug (not shown). The backpressure valve allows a flow from the bore 14 into the well 32 but blocks a flow from the well 32 into the bore 14 of the hanger 10. Further the hanger 10 comprises a pin thread arrangement 17 at the lower end thereof for connecting to further equipment.

The test cup 12 is arranged at the outer circumference of the hanger 10. Preferably the test cup 12 is arranged within a recess 13 of the hanger 10. The test cup 12 is an elastomeric seal cup body. In inserted condition of the cup tester unit 1 the test cup 12 abuts the inner surface of the casing and serves for a tight seal against a fluid pressure within the annular space 34 between the hanger 10 and the casing 30. The annular space 34 is further sealed at the top end by the BOP test plug 20.

For testing the connection 42 between the casing 30 and the casing head housing 40 pressure is applied to the annular space 34 and the pressure is observed over a period of time to determine any leaks. The pressure can be applied via the side outlet valve 44 of the casing head housing 40.

For testing a BOP a fluid pressure is applied to the space within the wellhead 100 above the BOP test plug 20.

Both pressure tests can be performed when the cup tester unit 1 is inserted into the wellhead 100. Preferably the tests can be performed at least partially simultaneously.

The invention claimed is:

1. A cup tester unit comprising:

a. a BOP test plug insertable into a casing head housing, wherein the BOP test plug is configured to seal a space of a drilling system above the BOP test plug, and wherein the BOP test plug is tapered in vertical downward direction from a bottom side and comprises a ring-shaped sealing surface which in fully inserted condition abuts a corresponding ring-shaped loading shoulder of a casing head housing, and wherein the ring-shaped sealing surface seals on the casing head housing when the BOP test plug reaches to a casing head housing loading shoulder stopper, and-;

b. a hanger connected to a pin thread arrangement of the BOP test plug by means of a threaded connection with a box thread arrangement at an upper end of the hanger, wherein the hanger has an elongate mandrel shape and comprises an axial bore, wherein the axial bore is selectively closed at its lower end by a one-way backpressure valve; and c. a test cup arranged within a recess of the hanger, wherein the test cup is configured to seal with the inner surface of a well casing connected to the casing head housing and provides a tight seal against a fluid pressure within an annular space between the hanger and the well casing, wherein the hanger positions the test cup below a connection between the well casing and the casing head housing;

wherein the BOP test plug comprises at its lower end a pin thread arrangement for a threaded connection with the box thread arrangement at the upper end of the hanger.

2. The cup tester unit according to claim 1, wherein the hanger comprises a pin thread arrangement at the lower end of the hanger.

3. The cup tester unit according to claim 1, wherein the test cup is an elastomeric seal cup body.

4. A method of testing the drilling system and a connection between the well casing and the casing head housing by the cup tester unit according to claim 1, comprising the following steps:

a. inserting fluid pressure into the drilling system in the space above the BOP test plug for testing a BOP, wherein the BOP test plug is insertable into the casing head housing, and wherein the BOP test plug is configured to seal a space of a drilling system above the BOP test plug, and wherein the BOP test plug is tapered in a vertical downward direction from the bottom side and comprises the ring-shaped sealing surface which in fully inserted condition abuts the corresponding ring-shaped loading shoulder of the casing head housing, and wherein the ring-shaped sealing surface seals on the casing head housing when the BOP test plug reaches to a casing head housing loading shoulder stopper, and wherein the BOP test plug comprises at its lower end the pin thread arrangement for the threaded connection with the box thread arrangement at the upper end of the hanger, wherein the hanger is connected to the pin thread arrangement of the BOP test plug by means of the threaded connection with the box thread arrangement at the upper end of the hanger, wherein the hanger has the elongate mandrel shape and comprises the axial bore, wherein the axial bore is selectively closed at its lower end by the one-way backpressure valve; and b. inserting fluid pressure into the casing head housing through a casing head housing side outlet in the space between the well casing below the BOP test plug and above the test cup for testing the connection between the well casing and the casing head housing, wherein the test cup is arranged within the recess of the hanger, wherein the test cup is configured to seal with the inner surface of the well casing connected to the casing head housing and provides the tight seal against the fluid pressure within the annular space between the hanger and the casing, wherein the hanger positions the test cup below the connection between the well casing and the casing head housing;

wherein the steps a. and b. are performed at least partially at the same time.

* * * * *